US005511504A

United States Patent [19]

Martin

[11] Patent Number: 5,511,504

[45] Date of Patent: Apr. 30, 1996

[54] COMPUTER CONTROLLED FINS FOR IMPROVING SEAKEEPING IN MARINE VESSELS

[76] Inventor: John R. Martin, 5635 Nebeshonee La., Rockford, Ill. 61103

[21] Appl. No.: 512,990

[22] Filed: Aug. 9, 1995

[51] Int. Cl.[6] ..... B63B 1/10

[52] U.S. Cl. ..... 114/61; 114/126

[58] Field of Search ..... 114/61, 121, 122, 114/123, 124, 125, 126, 271, 274, 280, 281, 282

[56] References Cited

U.S. PATENT DOCUMENTS

| | | | |
|---|---|---|---|
| 3,727,572 | 4/1973 | Nelson et al. | 114/126 |
| 4,095,547 | 6/1978 | Benington | 114/126 |
| 5,282,763 | 2/1994 | Dixon | 114/61 |
| 5,301,624 | 4/1994 | Hall et al. | 114/61 |

*Primary Examiner*—Stephen Avila

*Attorney, Agent, or Firm*—Snell & Wilmer; Sherman O. Parrett; Michael K. Kelly

[57] ABSTRACT

A control system for a SWATH type vessel has control fins mounted on the pontoons of the vessel to improve seakeeping. The control system includes roll angle and pitch angle sensors, and can include roll rate and pitch rate sensors or calculations for developing damping signals, with all the signals used to control the control fins to counteract roll and pitch. In addition, individual accelerometers are provided mounted to the vessel in a sufficient number and at sufficently diverse locations to sense vertical acceleration of the vessel, and vertical acceleration signals are used to control the control fins to provide improved control of roll and pitch, and also to counteract any heave or vertical movement of the vessel. Additionally, draft sensors are provided mounted to the vessel to generate draft or depth of immersion signals. These signals override the roll, pitch and heave signals to cause vertical movement of the vessel to counteract incipient slamming or broaching of the vessel. If desired, a predetermined threshold for draft discrepancies can be provided before any such overriding control is initiated.

12 Claims, 3 Drawing Sheets

COMPUTER CONTROLLED FINS FOR IMPROVING SEAKEEPING IN MARINE VESSELS

This invention pertains to control mechanisms for improving seakeeping in marine vessels, and more particularly pertains to providing computer controlled fins mounted to the pontoons or sponsoons of a SWATH type vessel, controlled by a computer fed with various sensor information for altering the lift provided by the fins to enhance seakeeping.

Both conventional V-hull and SWATH type vessels are moved by waves in a way that can produce motion sickness in passengers, as well as pose a threat to vessel safety in extreme conditions. V-hull type vessels are the conventional monohull type construction, and SWATH is an acronym referring to small water plane area twin hull vessels. Such SWATH vessels generally include two submerged and parallel pontoons, with struts extending upward from the pontoons to support a superstructure. SWATH type vessels have also been proposed and built with more than two pontoons—either four in parallel or two parallel configurations of two pontoons. The present invention is equally applicable to all these configurations. The buoyancy of the submerged pontoons and the submerged portions of the struts support the superstructure out of the water. Generally, propulsion means, such as engine driven propellers, are incorporated in the pontoons, and provide motive power for the vessel.

It is well known in both V-hull and SWATH type vessels to provide underwater horizontal stabilizers or canards or fins, to assist in maintaining stability of the vessel in terms of pitch and roll while moving at medium to higher speeds through calm or rough waters. Generally, a pendulum-equivalent device detects the roll angle of the ship and, through a computer, sends signals to two fins which act to minimize the rolling motion. To prevent over compensation, a damping signal proportional to the rate of roll can be derived from the pendulum signal or from an independent rate sensor and combined with the pendulum signal.

SWATH vessels, which typically control roll motion as discussed above, in addition also are known to control pitch motion. Pitch is controlled in a fashion similar to roll, through using fins or horizontal stabilizers, and through use of a pendulum equivalent device or the like for sensing pitch. As in the case of roll, the rate of pitch can be either directly derived from a sensor or calculated to generate a damping signal for avoiding over-compensation. Control of pitch on a SWATH type vessel is practical because the size of fins required to control pitch on such a vessel is about the same as required for roll control, as opposed to a much larger size required for pitch control on a V-hull type vessel.

In additional to the conventional roll and pitch controls on a SWATH type vessel discussed above, the prior art does contemplate some additional control features. For example, U.S. Pat. No. 5,301,624 discloses the use of stem planes in the aft portion of a SWATH type vessel to improve the performance thereof.

The control schemes for SWATH vessels discussed above suffer from limitations in their effectiveness because their control system gain (even with damping) is limited by the propensity for over-shooting and/or hunting (self-induced oscillations). Over-shooting and hunting are not at all desirable, and system limitations force the control system to utilize a lower gain and hence achieve less sensitivity. Further, the prior art control systems have no capability for controlling heave, or vertical translation of the vessel.

Moreover, if a SWATH type vessel is operating in areas where the waves are large, it may be desirable to allow or force the vessel to move in order to prevent slamming (water impacting the vessel from below) or broaching (allowing the propellers to pierce the surface of the water). Typically, this has been done in the past by use of a Captain's judgment in activating a control switch to allow the vessel to assume a pitch angle equal to the slope of the wave. This is referred to as a "contouring mode", as opposed to the "platforming mode" used in calmer water, which refers to keeping the vessel's plane parallel to the surface of the water.

OBJECTS AND SUMMARY OF THE INVENTION

It is an object of the present invention to provide an improved control system for controlling control fins or stabilizers on a SWATH type vessel to achieve improved seakeeping.

It is a more specific object of one aspect of the present invention to provide a control system for a SWATH type vessel which incorporates accelerometers located on the vessel to provide vertical acceleration signals to be combined with the control signals for control fins to provide earlier information for improved control of roll and pitch motions in a platforming mode, and to control heave or vertical motion of the vessel.

It is a more specific object in accordance with another aspect of the present invention to provide draft or depth of immersion sensors on a SWATH type vessel to provide automatic control signals for moving the vessel in a vertical direction to avoid slamming or broaching.

Briefly, in accordance with one embodiment of the invention, a SWATH type vessel has at least first and second pontoons disposed parallel to one another, with struts connecting the pontoons to a superstructure. Generally horizontally deployed control fins are mounted to the at least first and second pontoons, with a controller mechanism provided for individually varying the lift generated by each control fin, which could be by varying the angle of attack of each control fin with respect to the water through which the vessel is traveling, as one example. Roll sensing means are provided for sensing at least roll angle, and pitch sensing means are provided for sensing at least pitch angle. A computer means is responsive to the roll angle for developing a roll control signal applied to the controller mechanism for controlling the orientation or configuration and hence lift generated by the control fins to counteract roll, and the computer means is also responsive to pitch angle for developing a pitch control signal applied to the controller mechanism for controlling the orientation or configuration and hence lift generated by the control fins to counteract pitch.

In accordance with one aspect of the present invention, accelerometers are mounted at appropriate locations on the vessel to sense vertical acceleration and provide indications thereof to the computer means. The computer means combines the vertical acceleration indications with the roll and pitch control signals, whereby the vertical acceleration indications provide earlier indications of undesirable roll and pitch vessel movement and provide tighter control of roll and pitch motions in a platforming mode and control the control fins to oppose vertical motions of the vessel to provide heave control. In accordance with the invention two to four or more control fins can be provided, with sufficient accelerometers (two to four, for example) to provide an indication of vertical acceleration of the vessel.

In accordance with another aspect of the invention, draft or depth of immersion sensors are mounted to the vessel (on the pontoons, for example) for sensing draft discrepancies. In response to such signals, correcting signals are supplied to the computer means to override the roll and pitch control signals to control the control fins to induce sufficient vertical motion of the vessel as required to avoid slamming or broaching.

In accordance with the present invention, the accelerometers and resulting control may be provided by itself, the draft or depth of immersion sensors and resulting control may be provided by itself, or both may be combined in one control system.

Further objects and advantages of the present invention will be apparent from the detailed description provided herein taken in conjunction with the accompanying drawings.

DETAILED DESCRIPTION

Figure 1:
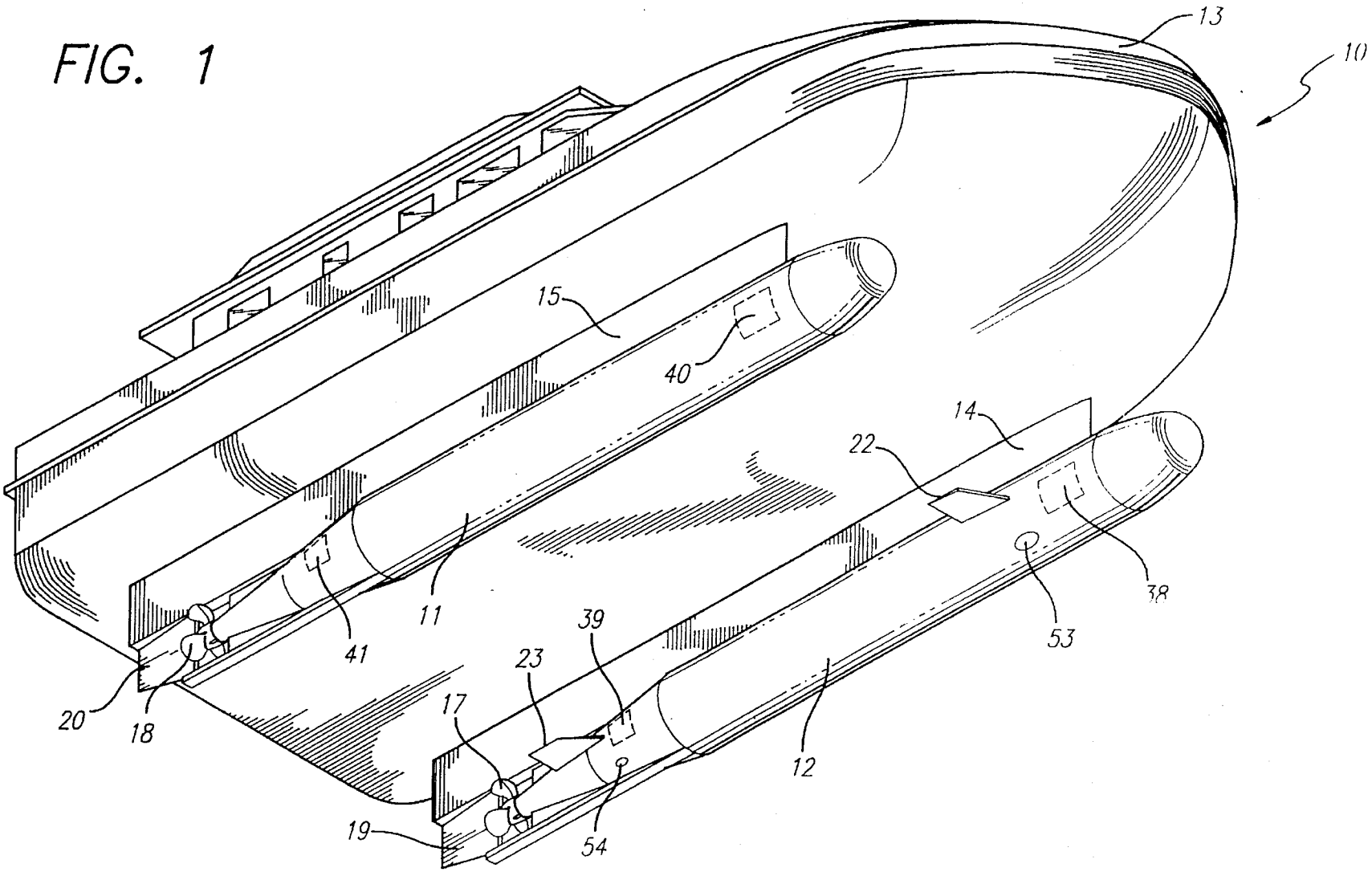
FIG. 1 is a perspective view of a SWATH type vessel, illustrating positioning of control fins, accelerometers, and draft sensors in accordance with various aspects of at least one embodiment of the present invention.

Turning now to FIG. 1, there is shown a perspective view of a SWATH type vessel. The vessel, generally indicated by reference numeral 10, comprises two pontoons 11 (starboard) and 12 (port), supporting a superstructure 13 by way of struts 14 and 15. Although this embodiment of the present invention will be explained with reference to a two pontoon SWATH vessel, it should be realized that SWATH vessel construction can include four or more pontoons, either all four parallel to each other or two parallel rows of two pontoons. Of course, in a SWATH type vessel, the pontoons along with a portion of the struts are submerged, and serve to provide the buoyancy for the entire vessel.

In FIG. 1, at the aft end of each of the pontoons 11 and 12 there are provided propellers 17 and 18 for providing motive power for the vessel. The propellers can be driven by engines located in the pontoons, or alternatively through engines mounted in the struts or superstructure and coupled to the propellers through drive arrangements. As shown in FIG. 1, typically rudders 19 and 20 are disposed aft of the propellers 17 and 18 for providing directional control for the vessel. Horizontally disposed fins or stabilizers can be attached to each of the starboard and port pontoons 12 and 11 at the forward and aft end of each pontoon, as shown in FIG. 1. Although the particular embodiment of the invention portrayed in FIG. 1 does show these four control fins, it is within the scope of the invention to provide less than four control fins or more than four control fins. For example, control fins can be provided only at the aft locations of the two pontoons, and a substantial portion of the benefits of the invention is realized. That is, while the control achieved is not quite as effective as in the case of using four fins and control arrangements, it still represents a significant advance over the prior art. Also, although the description of the invention in connection with the particular embodiment shown and described refers to what can be considered as generally horizontal control fins for whose angle of attack with respect to the water through which the vessel is passing is altered to provide upward or downward lift as appropriate, that is only one possible embodiment of the invention. For example, the fins need not be strictly horizontal, but could be on an angle. Alternatively, the fins could have a "flap" incorporated in their structure to alter the lift generated. The only requirement is that the "fins" be controllable to alter the amount and direction of lift generated.

Referring still to FIG. 1 and the specific embodiment there shown, port pontoon 12 has forward fin 22 and aft fin 23, and starboard pontoon 11 has forward fin 24 and aft fin 25. In accordance with the specific embodiment illustrated, the fins 22, 23, 24, and 25 each rotate horizontally to vary their angle of attack with respect to the water through which the vessel is passing, and thus generate a force to displace the pontoon end where they are located in either an upward or downward direction, depending on the angle of attack. While this embodiment of the invention refers to generally horizontally disposed, rotatable fins whose angle of attack is varied in accordance with the control system of this invention, obviously other arrangements could be utilized, as referred to above. In its broadest aspect the present invention contemplates a mechanical arrangement extending into the water through which the vessel is passing, and whose configuration is changed by the control system to control the lift generated by the mechanical arrangement.

The fins 22, 23, 24, and 25 as shown in the embodiment of FIG. 1 are suitably controlled to rotate in a desired direction by fin drivers 27, 28, 29, and 30, respectively, which can be electrically driven motors or the like of suitable power and resolution. Alternatively, the fins could be displaced or moved by suitable hydraulic arrangements.

In accordance with conventional practice, the SWATH vessel of FIG. 1 is equipped with sensors for sensing roll angle and pitch angle. If desired, and also in accordance with conventional practice, the vessel can also be equipped with sensors for measuring roll rate and pitch rate, or these values can be calculated. If so, such rate signals are using to generate a damping signal which can be combined with the angle sensors to provide what can be referred to as "damped" control signals to prevent overshooting, all in accordance with conventional practice. These are respectively shown as sensors 32, 33, 34, and 35 in FIGS. 2 and 3. These can be pendulum or pendulum-equivalent type sensors, or other types of sensors, and suitable arrangements are known to those skilled in the art. Signals from the roll and pitch sensors are input into a computer 36, which controls the fin drivers 27, 28, 29, and 30, all as shown in FIGS. 2 and 3.

In accordance with a first aspect of the present invention, the starboard and port pontoons 11 and 12 are each equipped with accelerometers at their forward and aft ends to sense vertical acceleration. While four accelerometers are shown in the embodiment of FIG. 1, obviously three accelerometers would be sufficient, with the fourth acceleration amount being calculated. That is, since three points completely define a plane, the plane of the four fins in FIG. 1 is completely defined by three values. Also, if an embodiment of the present invention is utilized in which only two control fins are provided, i.e., on the aft ends of the pontoons, either three or four accelerometers could still be utilized or only two utilized. It should also be clear that the accelerometers need not be mounted on the pontoons. The accelerometers can be mounted anywhere on the vessel so long as they are not in the same vertical plane, and will provide appropriate vertical acceleration indications.

Figure 2:
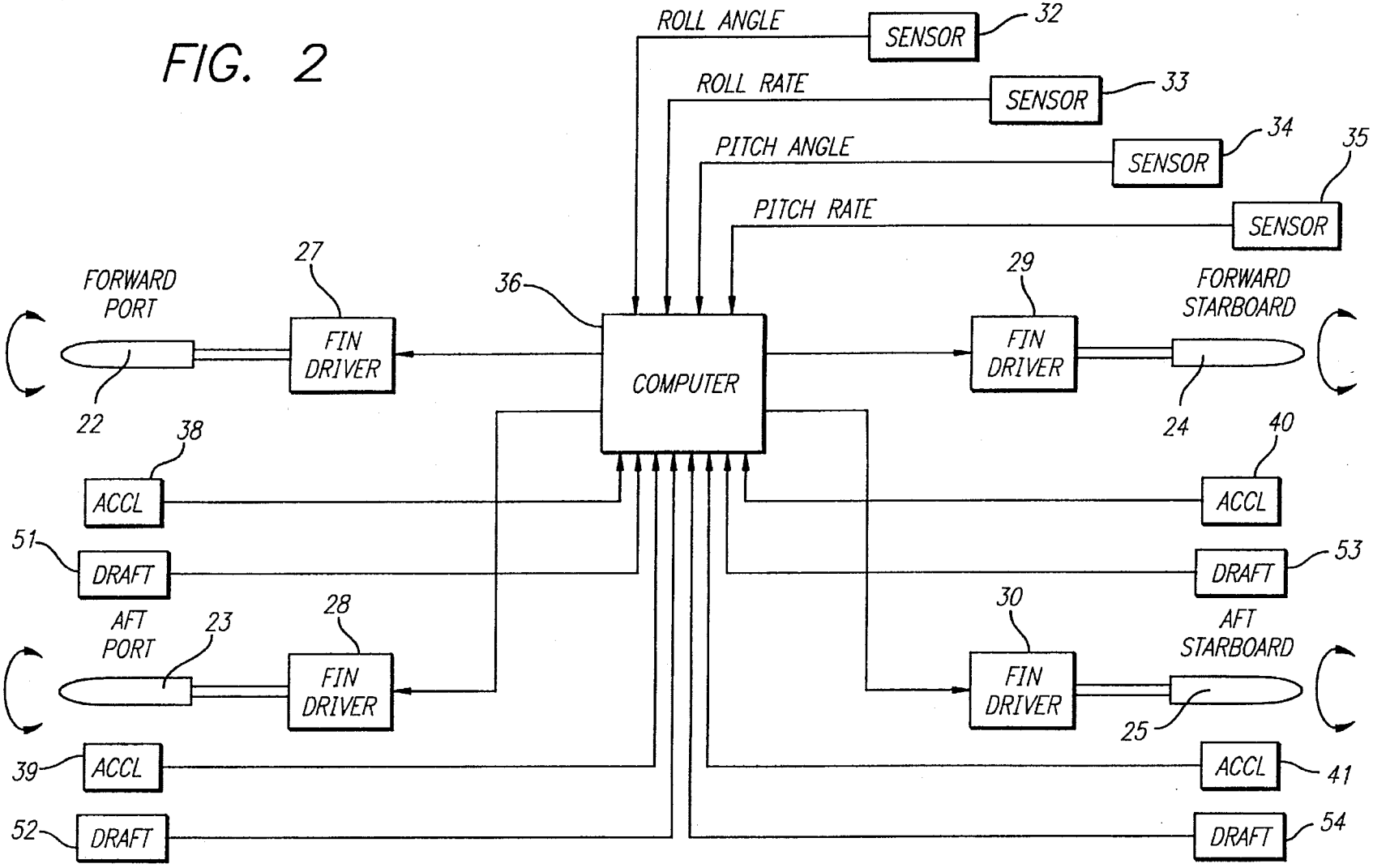
FIG. 2 is a block diagram showing the various control components and interconnections for regulating the position of control fins for the vessel in accordance with sensor inputs.
Figure 3:
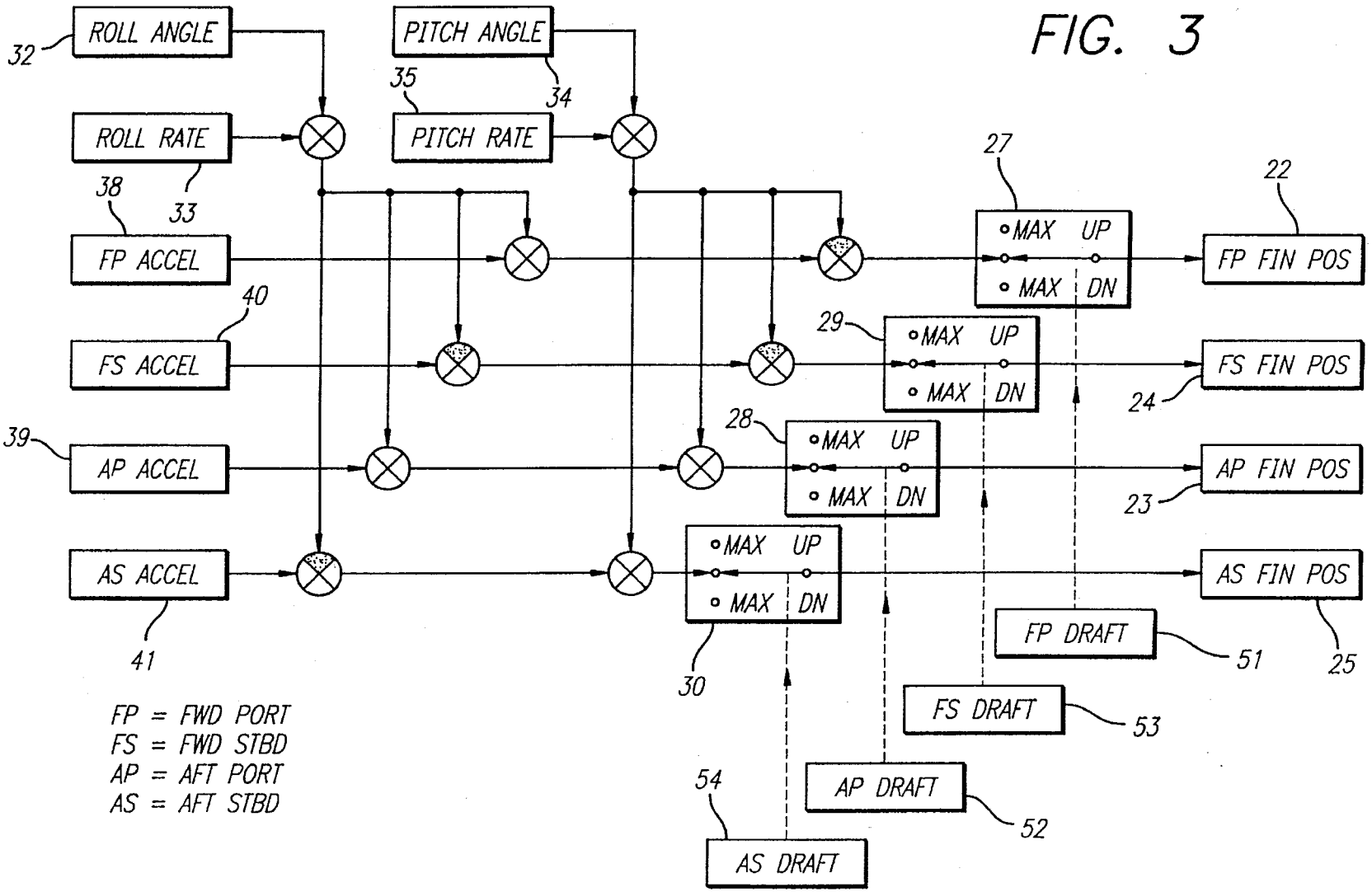
FIG. 3 is a functional control diagram showing control logic and function for the fins in FIGS. 1 and 2, illustrating both the control resulting from use of accelerometer signals and the overriding control using draft or depth of immersion sensors.

The accelerometers are diagrammatically shown in FIG. 1 and shown in block diagram form in FIG. 2 and functionally in FIG. 3, and comprise in this specific embodiment forward port accelerometer 38, aft port accelerometer 39, forward starboard accelerometer 40, and aft starboard accelerometer 41, all in accordance with the specific embodiment portrayed in the drawings. Signals from each of the accelerometers, representing vertical acceleration, are input into the computer 36. Many suitable types of accelerometers are known and are available to those skilled in this art.

Computer 36 combines the signals from the accelerometers with the pitch and roll signals for each of the four individual fin drivers to control fin rotation and positions, leading to significant advantages in improving roll and pitch control in accordance with the invention. Specifically, the accelerometers provide earlier information as to pitch and roll (a 90 degree phase lead of acceleration versus velocity or rate) providing less phase shift in the overall system. This allows tighter control or higher gain for the fin drivers or controllers, and leads to reduced roll and pitch motions in the "platforming" mode of operation of the vessel. The control of the fin drivers is straightforward in accordance with the sensor inputs, and a program for tailoring control signals applied by the computer 36 to the fins drivers in accordance with particular characteristics of each vessel to which such a system is fitted and the particular characteristics of the various sensors utilized in order to achieve the best seakeeping qualities in various conditions is easily achieved.

The incorporation of vertical acceleration signals into the control signals for controlling the fin drivers or controllers also enables a new mode of operation or control. Specifically, the individual fin drivers individually move the fins to control the lift provided by the fins to oppose vertical motions of the vessel. This provides control over heave, or vertical translation of the vessel, and this control is achieved even though there might not be any sensor control signals resulting from sensing roll or pitch.

In accordance with another aspect of the present invention, automatic operation is achieved with improved seakeeping with respect to pitch of the vessel in various conditions. In the prior art, control systems could be provided with a switch operated by the Captain of a vessel to change from a "platforming" mode (keeping the vessel level with respect to the waves) and a "contouring" mode, in which the vessel assumes a pitch angle equal to the slope of a wave. This was done in order to avoid slamming or broaching of the vessel in heavy sea conditions, where slamming refers to water impacting the vessel from below and broaching refers to allowing the propellers to pierce the surface of the water.

The present invention functions to automatically control pitch of a vessel to avoid slamming or broaching in a manner much improved over what has been done in the past. In order to achieve this operation, draft or depth of immersion sensors are provided on the vessel, which can be, for example, mounted at the forward and aft ends of the port and starboard pontoons near the control fins. As discussed before, since three points completely define a plane, the system shown in the drawings could be provided with only three such sensors, and a value for the fourth position calculated. The draft sensors are identified in the drawings as forward port draft sensor 51, aft port draft sensor 52, forward starboard draft sensor 53, and aft starboard draft sensor 54. These draft sensors are simply pressure sensors, or any other known kind of depth sensors, mounted on the pontoons below the water line to give an indication of the depth of immersion or draft at sufficent locations on the vessel to define the immersion of the "plane" of the vessel.

If desired, computer 36 can have a selected, preset threshold limit with regard to signals from the draft sensors. When the sensor signals exceed whatever is selected as the preset threshold, the control system is overridden (with respect to pitch and roll control) to generate lift via the control fins to move the vessel in a vertical direction to avoid slamming or broaching. This provides three overall benefits in connection with seakeeping. First, the anti-slam, anti-broach actions are automatic, thereby obviating judgement and input from the vessel's crew. Second, the control actions provided by the draft sensors, because they are invoked only when needed, induce only enough pitch and/or roll motion as is required to avoid slamming, or broaching. This motion will in all cases be less than the slope of the wave, i.e., this system will produce less undesirable motion than conventional systems which only function to switch from a platforming mode to a contouring mode, following the slope of the wave. Third, the motion caused by the draft sensors is always controlled, rather than simply "turned loose" as in conventional systems. Thus the motion is kept more in phase with the wave motion, further reducing the motion necessary to avoid slamming and broaching. Also, since the control action of the draft sensors during vertical excursions is such as to remove energy from the vessel, this method of control tends to damp the resonant response of the vessel to waves encountered at frequencies near the resonant frequency of the vessel.

Although the present invention has been described in connection with a presently preferred embodiment, it should be clear that variations from the specifics of that embodiment are possible and are within the skill of those working in this art. Many such variations have been mentioned in connection with the discussion of the specific embodiment shown in the drawings. The true scope of the present invention is intended to be measured by the appended claims.

I claim:

1. A pontoon vessel comprising:

a superstructure;

at least first and second pontoons disposed parallel to one another beneath the superstructure;

at least one strut disposed between each pontoon and the superstructure for supporting the superstructure, so that the combined buoyancy of the pontoons and submerged portions of the struts is sufficient to support the superstructure spaced above the waterline by a prescribed distance;

engine means for propelling the vessel;

control fins mounted to the pontoons and having a controller mechanism for individually varying the lift generated thereby as the vessel is moving through water;

roll sensing means for sensing roll angle;

pitch sensing means for sensing pitch angle;

computer means responsive to roll angle for developing a roll control signal which is applied to said controller mechanism for controlling the lift generated by said control fins to counteract roll;

said computer means also responsive to pitch angle for developing a pitch control signal which is applied to said controller mechanism for controlling the lift generated by said control fins to counteract pitch;

accelerometers mounted to the vessel for sensing vertical acceleration of the vessel and providing indications thereof to said computer means, with said computer means incorporating vertical acceleration indications with the roll and pitch control signals, whereby the vertical acceleration indications provide earlier indications of undesirable vessel movement than conventional roll and pitch indications and provide tighter control of roll and pitch motions in a platforming mode and control the control fins to oppose vertical motions of the vessel to provide heave control.

2. A pontoon vessel in accordance with claim 1 in which there are two pontoons and four control fins, said four control fins mounted at forward and aft ends of each pontoon.

3. A pontoon vessel in accordance with claim 1 in which said roll sensing means also senses roll rate to develop a damping roll control signal, and said pitch sensing means also senses pitch rate to develop a damping pitch control signal.

4. A pontoon vessel in accordance with claim 1 in which said controller mechanism varies the angle of attack of said control fins with respect to water through which the vessel is passing in order to control lift.

5. A pontoon vessel comprising:

a superstructure;

at least first and second pontoons disposed parallel to one another beneath the superstructure;

at least one strut disposed between each pontoon and the superstructure for supporting the superstructure, so that the combined buoyancy of the pontoons and submerged portion of the struts is sufficient to support the superstructure spaced above the waterline by a prescribed distance;

engine means for propelling the vessel;

control fins mounted to each of said pontoons and having a controller mechanism for individually varying the lift generated thereby as the vessel is moving through water;

roll sensing means for sensing roll angle;

pitch sensing means for sensing pitch angle;

computer means responsive to roll angle for developing a roll control signal which is applied to said controller mechanism for controlling lift generated by said control fins to counteract roll;

said computer means also responsive to pitch angle for developing a pitch control signal applied to said controller mechanism for controlling lift generated by said control fins to counteract pitch;

draft sensors mounted to each pontoon for generating signals representing draft, said computer means responsive to signals representing draft to control said controller mechanism for said control fins to override the roll and pitch control signals to control said control fins to induce sufficient vertical motion of the vessel as required to avoid slamming or broaching.

6. A pontoon vessel in accordance with claim 1, and further including draft sensors mounted to each pontoon for generating signals representing draft, said computer means responsive to signals representing draft to control said controller mechanism for said control fins to override the roll and pitch control signals to control said control fins to induce sufficient vertical motion of the vessel as required to avoid slamming or broaching.

7. A pontoon vessel in accordance with claim 5 in which there are two pontoons and four control fins, said four control fins mounted at forward and aft ends of each pontoon.

8. A pontoon vessel in accordance with claim 5 in which said roll sensing means also senses roll to develop a damping roll control signal, and said pitch sensing means also senses pitch rate to develop a damping pitch control signal.

9. A pontoon vessel in accordance with claim 5 in which said controller mechanism varies the angle of attack of said control fins in order to control lift.

10. A control system for a pontoon vessel of the type having at least first and second pontoons disposed parallel to one another and connected by struts to a superstructure and having control fins mounted to the pontoons with a controller mechanism for individually varying the configuration of each control fin to control the lift generated thereby as the vessel travels through water, said control system comprising:

roll sensing means for sensing roll angle;

pitch sensing means for sensing pitch angle;

computer means responsive to roll angle for developing a roll control signal applied to the controller mechanism for controlling configuration of the control fins to counteract roll;

said computer means also responsive to pitch angle for developing a pitch control signal applied to the controller mechanism for controlling configuration of the control fins to counteract pitch;

individual accelerometers mounted to the vessel for sensing vertical acceleration and providing indications thereof to said computer means, with said computer means incorporating vertical acceleration indications with the roll and pitch control signals, whereby the vertical acceleration indications provide earlier indications of vessel roll and pitch and provide improved, tighter control of roll and pitch motions in a platforming mode and also control the control fins to oppose vertical motions of the vessel at the positions of the control fins to provide heave control.

11. A control system for a pontoon vessel of the type having at least first and second pontoons disposed parallel to one another and connected by struts to a superstructure and having control fins mounted to the pontoons with a controller mechanism for individually varying the configuration of each control fin to control the lift generated thereby as the vessel travels through water, said control system comprising:

roll sensing means for sensing roll angle;

pitch sensing means for sensing pitch angle;

computer means responsive to roll angle for developing a roll control signal applied to the controller mechanism for controlling configuration of the control fins to counteract roll;

said computer means also responsive to pitch angle for developing a pitch control signal applied to the controller mechanism for controlling configuration of the control fins to counteract pitch;

draft sensors mounted to the vessel for generating signals representing draft, said computer means responsive to signals representing draft to control said controller mechanism for said control fins to override the roll and pitch control signals to control said control fins to induce sufficient vertical motion of the vessel as required to avoid slamming or broaching.

12. A control system in accordance with claim 10 also including individual draft sensors mounted to each pontoon for generating signals representing draft, said computer means responsive to signals representing draft in excess of a predetermined threshold to control said controller mechanism for said control fins to override the roll and pitch control signals to control said control fins to induce sufficient vertical motion of the vessel as required to avoid slamming or broaching.

* * * * *